US008341771B2

(12) United States Patent
Lee

(10) Patent No.: US 8,341,771 B2
(45) Date of Patent: Jan. 1, 2013

(54) OPENING/CLOSING APPARATUS AND HELMET INCLUDING THE SAME

(75) Inventor: Chang Seob Lee, Gyeonggi-do (KR)

(73) Assignee: HJC Corporation, Gyeonggi-Do (KR)

( * ) Notice: Subject to any disclaimer, the term of this patent is extended or adjusted under 35 U.S.C. 154(b) by 208 days.

(21) Appl. No.: 12/880,687

(22) Filed: Sep. 13, 2010

(65) Prior Publication Data

US 2011/0067158 A1 Mar. 24, 2011

(30) Foreign Application Priority Data

Sep. 24, 2009 (KR) ..... 10-2009-0090524

(51) Int. Cl.
*A42B 1/08* (2006.01)

(52) U.S. Cl. ..... 2/424; 2/6.3; 2/15

(58) Field of Classification Search ..... 2/15, 410, 2/6.7, 8.3, 424, 5, 6.1–6.6, 422, 10, 9, 12, 2/13, 425, 417, 420, 421
See application file for complete search history.

(56) References Cited

U.S. PATENT DOCUMENTS 2,274,222 A * 2/1942 Tedrow ..... 2/10
3,050,735 A * 8/1962 Newman et al. ..... 2/6.5
3,066,305 A * 12/1962 Aileo ..... 2/431
3,400,407 A * 9/1968 Aileo ..... 2/6.5
3,495,273 A * 2/1970 Aileo ..... 2/6.4
3,548,411 A * 12/1970 Barstow et al. ..... 2/6.5
4,170,042 A * 10/1979 Aileo ..... 2/424
2003/0131396 A1* 7/2003 Park ..... 2/183
2007/0136933 A1* 6/2007 Kim et al. ..... 2/424

* cited by examiner

*Primary Examiner* — Khoa Huynh
*Assistant Examiner* — Brieanna Fuller
(74) *Attorney, Agent, or Firm* — Pearne & Gordon LLP

(57) ABSTRACT

An opening/closing apparatus capable of manipulating a sun visor, which is opened and closed at a front side of a front opening of a helmet main body, from a top portion of the helmet is provided. The opening/closing apparatus includes a sliding member in which its one end portion is coupled to a central top end portion of the sun visor, and a grip helping the sliding member to move forwards and backwards is formed at another end portion, a guide holder that is attached to an inner top portion of the helmet main body and guides a forward and a backward movement of the sliding member, and a damper that is a saw-toothed member and is attached to one side of the guide holder.

8 Claims, 7 Drawing Sheets

OPENING/CLOSING APPARATUS AND HELMET INCLUDING THE SAME

FIELD OF THE INVENTION

The present disclosure relates to an opening/closing apparatus allowing a sun visor of a front opening at a front side of a helmet to be opened and closed and a helmet, more particularly, an opening/closing apparatus helping a sun visor to be opened and closed at a constant speed and a helmet including the same.

BACKGROUND OF THE INVENTION

A rider is necessarily required to wear a helmet when riding a two-wheeled vehicle such as a motorcycle, and the helmet generally has a front opening at a front side of its main body in order to allow a wearer to obtain a front view. Further, the helmet generally has a selectively retractable shield to prevent wind or dust from being introduced through the front opening while the motorcycle moves forwards. Furthermore, a retractable sun visor may be installed within the shield in order to protect the wearer's eyes from direct sunlight in the daytime.

Both end portions of the sun visor are clamped to hinge shafts provided at both lateral sides of the helmet main body, and the clamped sun visor may move forwards and backwards by an operation of a manipulating lever or manipulating grip installed at a top portion of the helmet or one of the both end portions thereof.

However, in case of a sun visor having a manipulating lever installed at one of its both end portions, the other end portion at which the manipulating lever is not installed is configured to passively move. Accordingly, when opening or closing the sun visor, the sun visor may move unstably due to an imbalance in force.

Moreover, even in case of a sun visor having a manipulating lever installed at a top portion of a helmet, it is inconvenient that an opening/closing speed of the sun visor may be too fast or too slow depending on a magnitude of the force applied to the manipulating lever.

Besides, it has been pointed out that the sun visor to be inserted into the helmet main body often collides with the helmet main body, making some collision noise and shortening a life span of the sun visor.

BRIEF SUMMARY OF THE INVENTION

The present disclosure provides an opening/closing apparatus of a helmet sun visor which allows the sun visor to be opened and closed stably with only a minimum operation of the opening/closing apparatus installed at a top portion of the helmet and a helmet including the opening/closing apparatus.

Further, the present disclosure provides an opening/closing apparatus of a sun visor which lengthens a life span of the retractable sun visor by avoiding a collision between the sun visor and a helmet main body and makes less collision noise and a helmet including the opening/closing apparatus.

In view of the foregoing, the present disclosure provides an opening/closing apparatus capable of manipulating a sun visor, which is opened and closed at a front side of a front opening of a helmet main body, from a top portion of the helmet, the opening/closing apparatus including: a sliding member in which its one end portion is coupled to a central top end portion of the sun visor, and a grip helping the sliding member to move forwards and backwards is formed at the other end portion; a guide holder that is attached to an inner top portion of the helmet main body and guides a forward and a backward movement of the sliding member; and a damper that is attached to one side of the guide holder such that the sliding member is moved forwards and backwards at a constant speed. A saw-toothed uneven surface portion may be formed at one side surface of the sliding member, and the uneven surface portion may allow the sliding member to move forwards and backward in gear with the damper, thereby making the sun visor opened and closed at a constant speed.

Further, the sliding member may include a returning spring of which one end is connected with a rear surface of the one end portion of the sliding member, and the other end is connected with a bottom surface of the guide holder. The returning spring may have elasticity when the sliding member moves forwards, and the sliding member automatically may return to its original position from a forward position by the elasticity of the returning spring, so that the sun visor automatically moves to a hidden position.

Furthermore, the sliding member may include a connector, at the one end portion, which is coupled to the central top end portion of the sun visor. The connector may serve as a connecting groove into which an insertion-type stopper formed at the central top end portion of the sun visor is inserted.

Further, the guide holder may include a button assembly accommodating part protruded from a specified position to accommodating a button assembly. The button assembly, while being accommodated in the button assembly accommodating unit, may be engaged with a lower surface of the sliding member to fix a position of the sun visor and released from the lower surface of the sliding member to cancel the fixed position of the sun visor.

Further, the button assembly may include a body constituting a part of the button assembly; a cavity penetrating the body such that the sliding member is moved forwards and backwards; a manipulation button that includes an engaging protrusion protruded upwardly from a bottom surface of the cavity and a elastic protrusion protruded downwardly from the lower surface of the body; and an elastic member, to which the elastic protrusion is inserted, configured to elastically support the manipulation button. The engaging protrusion may be engaged with an engaging member installed at the lower surface of the sliding member positioned in the cavity by the forward movement of the sliding member, so that the sliding member moved forwards is maintained as moved.

Further, in the helmet including the helmet main body in which a facial front opening to be opened and closed by the sun visor is installed at a front side and hinge shafts to be clamped to the sun visors respectively are installed at both sides, the above-described purposes of the present disclosure can be achieved by providing a helmet including a sun visor clamped to an inside of a helmet main body through hinge shafts at both sides of the helmet main body, the helmet including: a sun visor detachably clamped to the hinge shafts via through holes formed at both ends to be moved forwards and backwards in front of a front opening; and an opening/closing apparatus including: a sliding member in which its one end portion is coupled to a central top end portion of the sun visor, a grip helping the sliding member to move forwards is formed at the other end portion, and an uneven surface portion is formed at one side surface, a guide holder that is attached to a top portion of the helmet main body and guides a forward and a backward movement of the sliding member, and a damper that is attached to one side of the guide holder such that the sliding member is moved forwards and backwards at a constant speed. When the sliding member moves forwards and backwards, the uneven surface portion may allow the sliding member to move forwards and backward in gear with the damper, so that speeds of forward and backward movements of the sliding member are maintained as predetermined, thereby making the sun visor opened and closed at a constant speed.

Further, the opening/closing apparatus may include a returning spring of which both ends are connected with a rear surface of the one end of the sliding member and a bottom surface of the guide holder, respectively. The returning spring may have elasticity when the sliding member moves forwards, and the sliding member automatically may return to its original position from a forward position by the elasticity of the returning spring, so that the sun visor automatically moves to a hidden position.

Furthermore, the sliding member may include a connector, at the one end portion, which is coupled to the central top end portion of the sun visor. The connector may serve as a connecting groove into which an insertion-type stopper formed at the central top end portion of the sun visor is inserted.

Further, the guide holder may include a button assembly accommodating part protruded from a specified position to accommodating a button assembly. The button assembly, while being accommodated in the button assembly accommodating unit, may be engaged with a lower surface of the sliding member to fix a position of the sun visor and released from the lower surface of the sliding member to cancel the fixed position of the sun visor.

Furthermore, the button assembly may include a body constituting a part of the button assembly; a cavity penetrating the body such that the sliding member is moved forwards and backwards; a manipulation button that includes an engaging protrusion protruded upwardly from a bottom surface of the cavity, and a elastic protrusion protruded downwardly from the lower surface of the body; and an elastic member, to which the elastic protrusion is inserted, configured to elastically supporting the manipulation button. The engaging protrusion may be engaged with an engaging member installed at the lower surface of the sliding member positioned in the cavity by the forward movement of the sliding member, so that the sliding member moved forwards is maintained as moved.

Further, the opening/closing apparatus may be configured that when the sliding member is automatically returned to its original position by the elasticity of the returning spring, the damper rotates in gear with the uneven surface portion and attenuates the elasticity, thereby preventing the sun visor moving to the hidden position from colliding with the helmet main body.

In view of the foregoing, the present disclosure provides a helmet including a sun visor clamped to an inside of a helmet main body through hinge shafts at both sides of the helmet main body, the helmet including: a sun visor detachably clamped to the hinge shafts via through holes formed at both ends to be moved forwards and backwards in front of a front opening; an opening/closing apparatus including: a sliding member in which its one end portion is coupled to a central top end portion of the sun visor, and a grip helping the sliding member to move forwards is formed at the other end portion, and a guide holder that is attached to a top portion of the helmet main body to guides a forward and a backward of the sliding member and includes a button assembly accommodating unit protrudes from a specified position; a returning spring of which both ends are connected with a rear surface of the one end of the sliding member and a bottom surface of the guide holder, respectively; and the button assembly accommodated in the button assembly accommodating unit and fitted to the lower surface of the sliding member. The button assembly may be engaged with the lower surface of the sliding member to fix an exposed/hidden position of the sun visor and released from the lower surface of the sliding member to cancel the fixed exposed/hidden position of the sun visor.

In accordance with one of methods of the present disclosure, while wearing a helmet, a helmet wearer can open and close a sun visor readily and stably without a need to take off the helmet.

Further, an opening/closing speed of the sun visor can be precontrolled not to be too fast, so that a collision between the sun visor and the helmet main body can be prevented and a life span of the sun visor can be lengthened.

BRIEF DESCRIPTION OF THE DRAWINGS

The disclosure may best be understood by reference to the following description taken in conjunction with the following figures:

FIG. 4A illustrates a case where a sliding member moves forwards, and FIG. 4B illustrates a case where a sliding member moves backwards; FIG. 5A illustrates a state before pressing a manipulation button or a returned state after pressing the manipulation button and FIG. 5B illustrates a state right after pressing the manipulation button which moves downwards by force downwardly applied thereto.

DETAILED DESCRIPTION OF THE INVENTION

Figure 1:
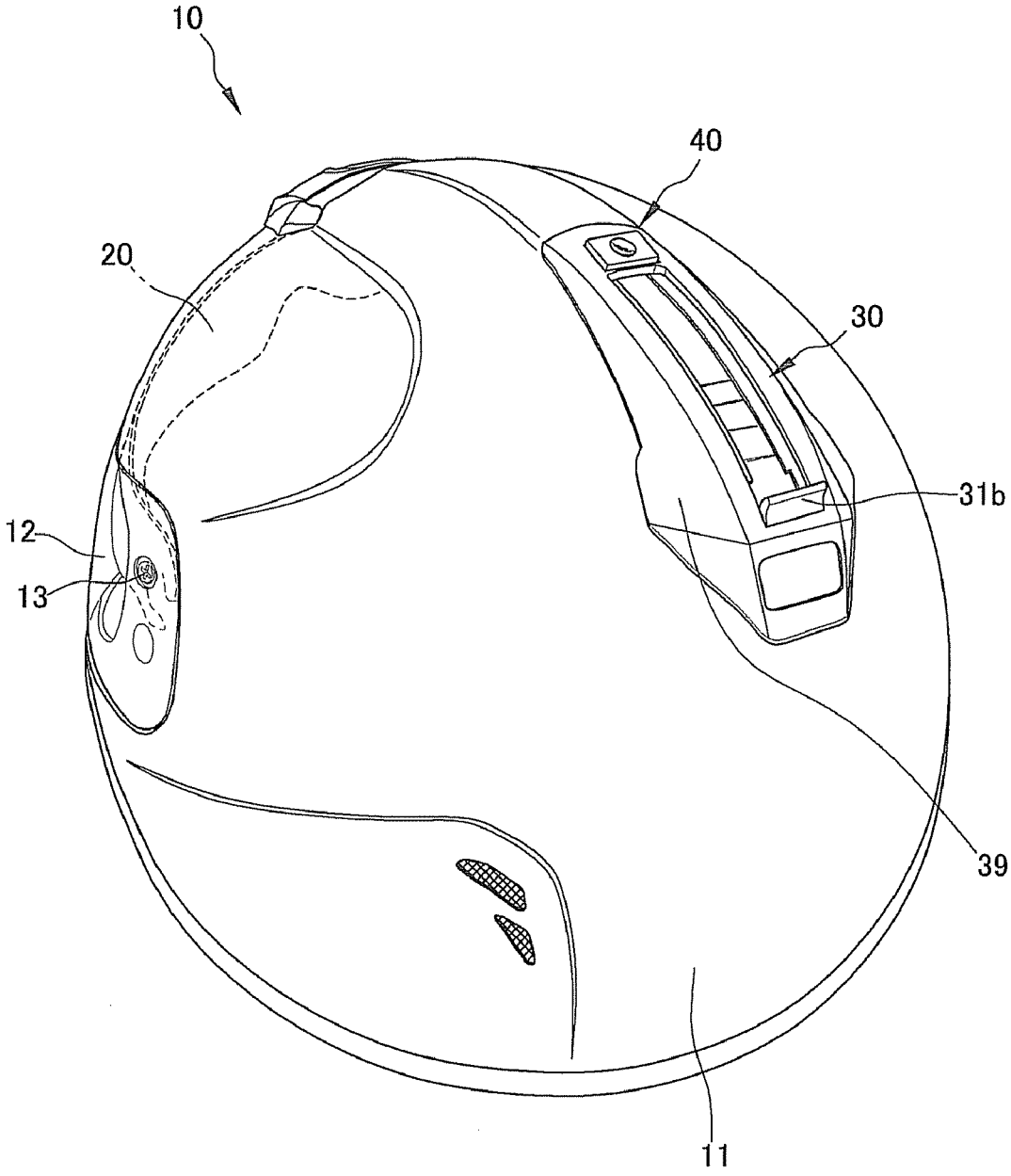
FIG. 1 is a perspective view of a helmet in accordance with an embodiment of the present invention.

Hereinafter, embodiments of the present invention will be described in detail with reference to the accompanying drawings so that the present invention may be readily implemented by those skilled in the art. However, it is to be noted that the present invention is not limited to the embodiments but can be realized in various other ways. In the drawings, parts irrelevant to the description are omitted for the simplicity of explanation, and like reference numerals denote like parts through the whole document.

Through the whole document, the term "connected to" or "coupled to" that is used to designate a connection or coupling of one element to another element includes both a case that an element is "directly connected or coupled to" another element and a case that an element is "electronically connected or coupled to" another element via still another element. Further, the term "comprises or includes" and/or "comprising or including" used in the document means that one or more other components, steps, operation and/or existence or addition of elements are not excluded in addition to the described components, steps, operation and/or elements.

Hereinafter, there will be explained an opening/closing apparatus of a helmet sun visor and a helmet in accordance with an embodiment of the present invention with reference to FIGS. 1 to 5.

FIG. 1 is a perspective view of a helmet 10 in accordance with an embodiment of the present invention. The helmet 10 in accordance with the present disclosure includes a sun visor 20 which can be manipulated from a top portion of the helmet 10, an opening/closing apparatus 30 and a button assembly 40.

The helmet 10 is used by a driver of a racing car or a rider of a motorcycle to protect his/her head from a possible accident, and thus the helmet 10 has a helmet main body 11 where a wearer's head can be accommodated.

The helmet main body 11 constitutes a main body of the helmet 10, and its inside where the wearer's head is accommodated is made of an elastic material such as urethane and the inside is made to fitly enclose the wearer's head. The helmet main body 11 has a front opening 12 at its front side and has hinge shafts 13 at both lateral sides. The front opening 12 is clamped to the hinge shafts 13 such that a sun visor 20 can be opened and closed.

The sun visor 20 is made of a light proof material such as plastic, thereby protecting a wearer's eyes from direct sun light in the daytime and allowing the wearer to sufficiently obtain a front view despite a strong sunlight or reflected light. The sun visor 20 is clamped to the hinge shafts 13 so as to be opened or closed. Further, the sun visor 20 is included within the helmet main body 11 and is opened and closed in front of the front opening 12. As long as the sun visor 20 can be opened and closed within the helmet main body 11, it may be manufactured to have various forms, shapes and colors. The sun visor 20 can be opened (exposed position) toward the front opening 12 provided at the front side of the helmet main body 11 and can be inserted (hidden position) into the helmet main body 11 at night so as to obtain a clearer view. In order to do so, the sun visor 20 includes shaft insertion grooves 23 at its both end portions and the sun visor 20 is clamped to the helmet main body 11 by the hinge shafts 13 each passing through the shaft insertion grooves 23. Further, the sun visor 20 coupled to the opening/closing apparatus 30, which will be described later, such that the wearer can open and close the sun visor 20 readily and stably.

The opening/closing apparatus 30 allows an opening/closing operation of the sun visor 20 to be manipulated from the top portion of the helmet 10. In order to do so, the opening/closing apparatus 30 is attached to the top portion of the helmet main body 11 and part of the opening/closing apparatus 30 is exposed to the outside thereof. Since the opening/closing apparatus 30 is attached to the top portion of the helmet main body 11 and part of the opening/closing apparatus 30 is exposed to the outside thereof, the wearer can open and close the sun visor 20 readily with a balance of force maintained from the top portion of the helmet 10. That is, if the wearer pushes a grip 31*b* of a sliding member 31, which will be described later, in the forward direction (forward moving), the sun visor 20 is opened toward the front opening (exposed position), so that the wearer can use the sun visor 20. On the contrary, if the wearer pushes the grip 31*b* in the backward direction (backward moving), the sun visor 20 is inserted into the helmet main body 11 (hidden position), so that the wearer may stop using the sun visor 20. The opening/closing apparatus 30 may include a cover 39 capable of preventing malfunction of the opening/closing apparatus as well as preventing introduction of any foreign substances such as dust from the top portion of the helmet 10.

The cover 39 covers and protects the opening/closing apparatus 30 exposed at the top portion of the helmet 10, and the cover 39 is configured to close an opening at the top portion of the helmet 10 without any obstruction to the operations of the button assembly 40 and the opening/closing apparatus 30 exposed to the outside.

Further, the opening/closing apparatus 30 may include the button assembly 40 that can prevent the sun visor 20 from being opened or closed arbitrarily regardless of the wearer's intention.

Furthermore, the button assembly 40 allows an opening/closing operation of the sun visor 20 to be manipulated from the top portion of the helmet 10, and the button assembly 40 may be protruded from the part of the opening/closing apparatus 30 or may be provided as a separate member. The button assembly 40 is configured to be easily engaged with and released from the opening/closing apparatus 30, whereby a position of the sun visor 20 can be maintained as it is until any further manipulation is made.

Hereinafter, there will be explained configurations of the sun visor 20, the opening/closing apparatus 30 and the button assembly 40 in detail with reference to FIGS. 2 and 3.

Figure 2:
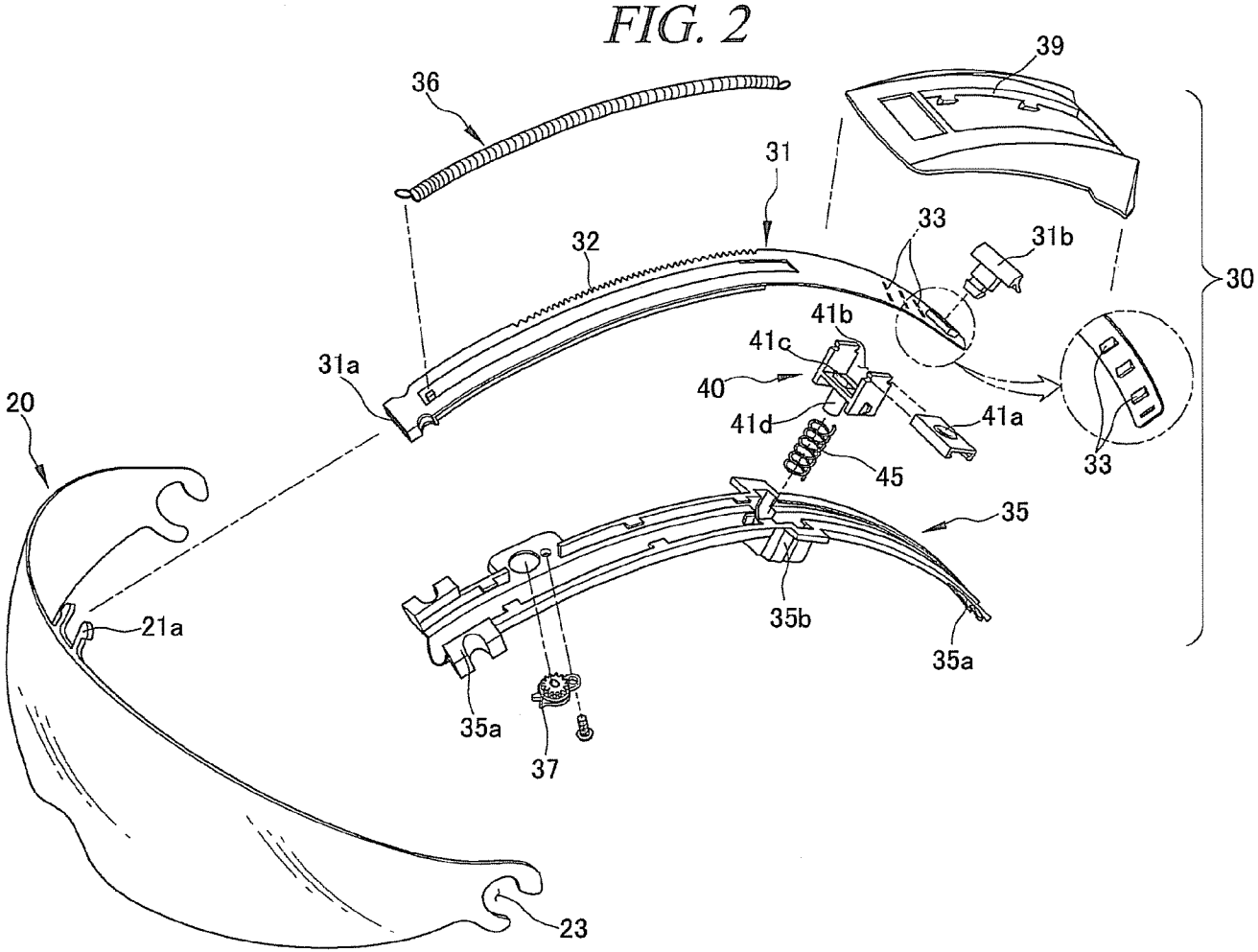
FIG. 2 is an exploded perspective view of an opening/closing apparatus in accordance with an embodiment of the present invention.
Figure 3A:
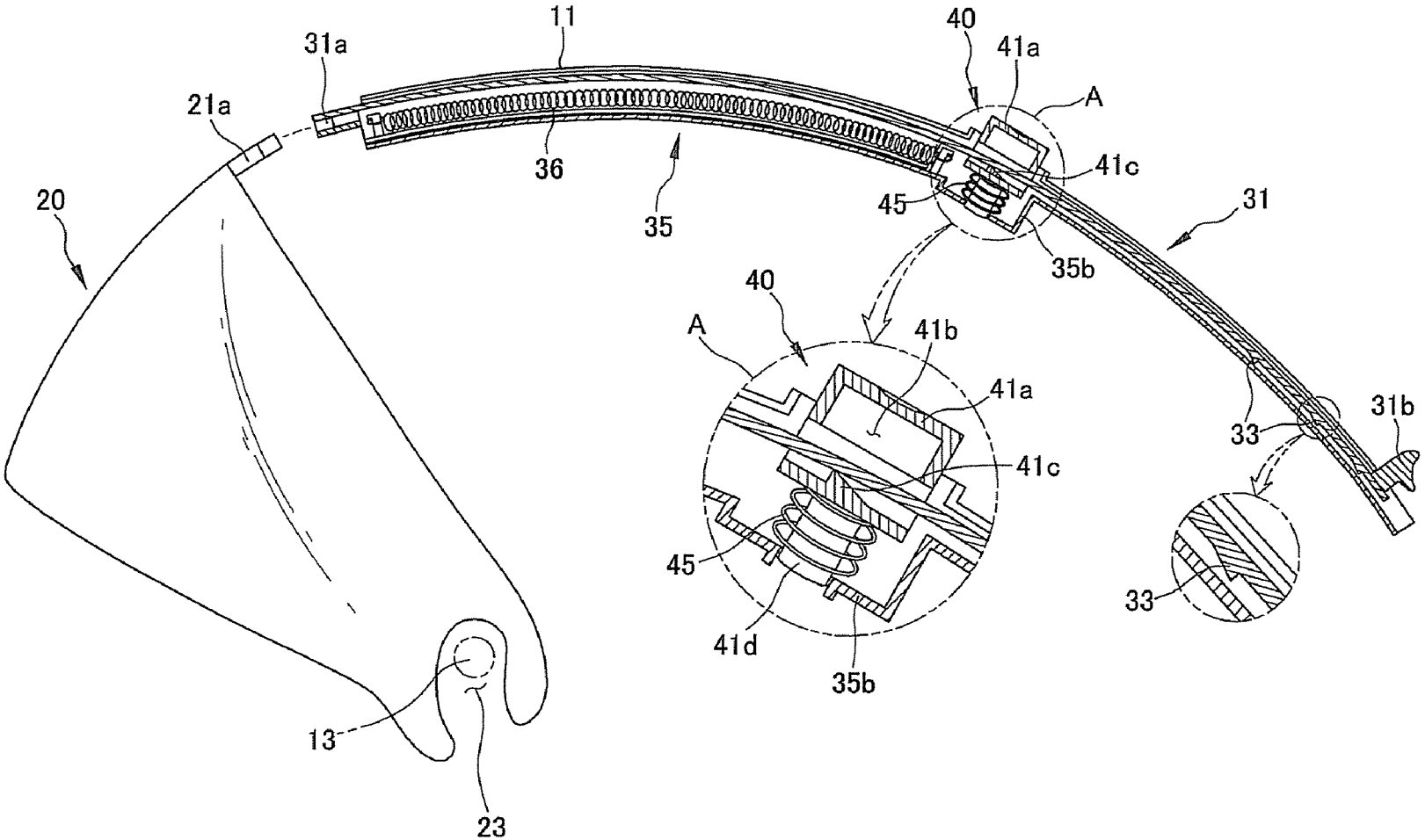
FIG. 3A is a transversal cross-sectional view of a sun visor, an opening/closing apparatus and a button assembly.
Figure 3B:
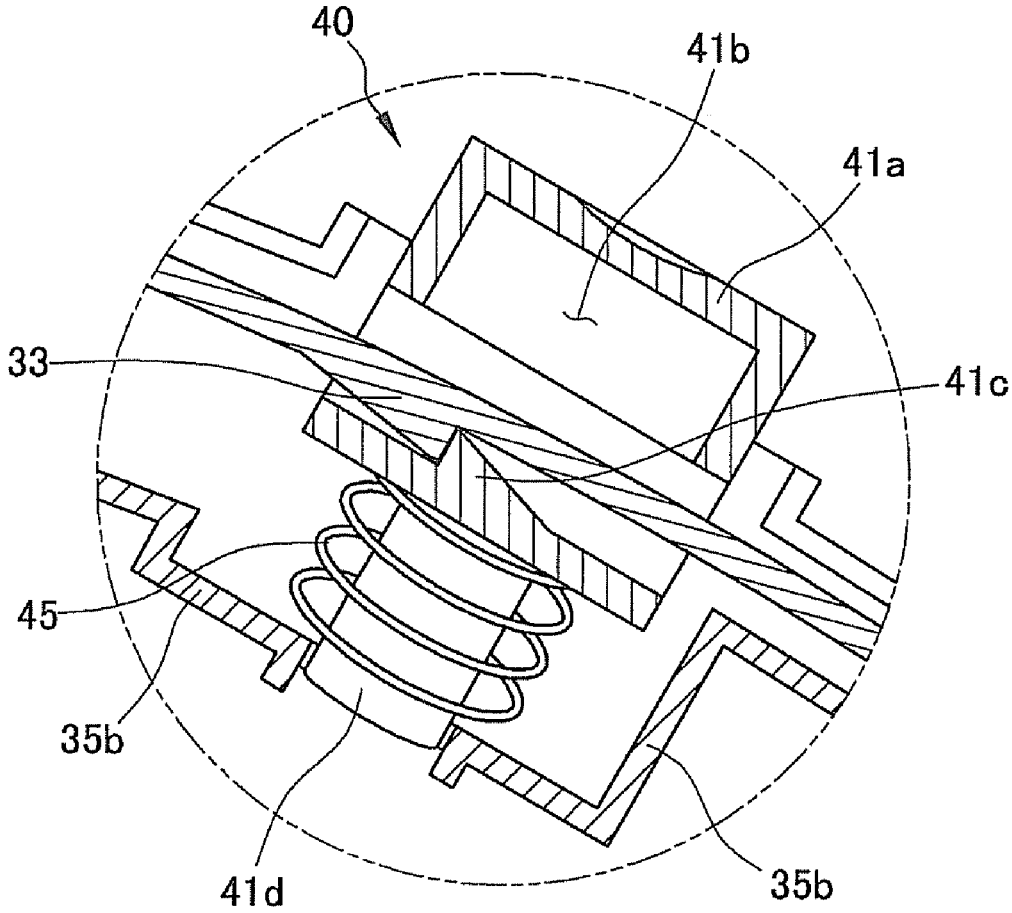
FIG. 3B is an enlarged transversal cross-sectional view of an area A of FIG. 3A showing that an engaging member formed at a lower surface of a sliding member is engaged with an engaging protrusion of a button assembly.

FIG. 2 is an exploded perspective view in accordance with an embodiment of the present invention and FIG. 3A is a transversal cross-sectional view of the sun visor 20, the opening/closing apparatus 30 and the button assembly 40. An area A of FIG. 3A is a cross-sectional view of the button assembly 40 accommodating the sliding member 31 which can be moved forwards and backwards. Further, FIG. 3B is an enlarged transversal cross-sectional view of the area A of FIG. 3A showing that an engaging member 33 formed at a lower surface of the sliding member 31 is engaged with an engaging protrusion 41*c* of the button assembly 40.

The sun visor 20 is coupled to the opening/closing apparatus 30 so as to be manipulated from the top portion of the helmet. The sun visor 20 may be integrated with the opening/closing apparatus wholly or partially by being coupled to the opening/closing apparatus. Alternatively, the sun visor 20 may include an insertion-type stopper 21*a* formed at its central top end portion and the stopper 21*a* is inserted into one end portion of the opening/closing apparatus 30 such that the sun visor 20 can be coupled to the opening/closing apparatus 30 as illustrated in FIG. 2.

The opening/closing apparatus 30 may include the sliding member 31, a guide holder 35, a returning spring 36, a damper 37, and a cover 39 so that an opening/closing operation of the sun visor 20 is allowed to be manipulated from the top portion of the helmet 10. The sun visor 20 is moved to the exposed position by a forward movement of the opening/closing apparatus 30 and moved to the hidden position by a backward movement of the opening/closing apparatus 30.

The sliding member 31 slidably moves forwards and backwards as guided by the following guide holder 35 and its one end portion is coupled to the sun visor 20. The sliding member 31 may include a connector 31*a*, the grip 31*b*, an uneven surface portion 32 and the engaging member 33.

The connector 31*a* serves as a coupling member provided at one end portion of the sliding member 31 and configured such that the insertion-type stopper 21*a* formed at the central top end portion of the sun visor 20 is inserted into the connector 31*a*. Further, the sun visor 20 may be easily separated from the opening/closing apparatus 30 or, if necessary, replaced by releasing the insertion-type stopper 21*a* from the connector 31*a*.

The grip 31*b* is installed at the other end portion of the sliding member 31 and assists the sliding member 31 to move forwards and backwards. Further, the wearer may push or pull the sliding member 31 forwards or backwards with the grip 31*b*. The grip 31*b* is exposed to the outside of the helmet main body 11 and may be protruded such that the wearer can push and pull the grip 31*b* with the helmet on by using his/her hand.

The uneven surface portion 32 is a portion of one side surface of the sliding member 31 with a number of saw-toothed irregularities formed thereon and it is configured to gear with the damper 37 to be described later. The uneven surface portion 32 may be formed at either one of the right side surface or the left side surface of the sliding member 31, or it may be formed at both side surfaces of the sliding member 31 and the damper 37 is also attached to its corresponding position so as to adjust speeds of the forward and backward movements of the sliding member 31. The uneven surface portion 32 is configured to gear with the damper 37, so that even if a strong force is delivered through the grip 31*b* (if the grip is strongly pushed or pulled), the speed of the forward and backward movements of the sliding member 31 can be adjusted to a predetermined speed by the damper 37. Accordingly, it is possible to solve problems such as inconvenience caused by a sudden opening or closing of the sun visor 20, noise made by a collision between the sun visor 20 and the helmet main body 11, and a reduced life span of the sun visor 20.

The engaging member 33 is a coupling member provided at a lower surface of the sliding member 31 to maintain the sliding member 31 as moved forwards. The engaging member 33 may be formed into a connection groove with which the engaging protrusion 41*c* of the button assembly 40 can be engaged, or the engaging member 33 may be formed into a protrusion protruded from the lower surface. Further, the engaging member 33 may be formed into one or more grooves having a size and an area as large as possible to accommodate the engaging protrusion 41*c*. Furthermore, the engaging member 33 may be engaged to the engaging protrusion 41*c* such that the sun visor 20 moved to the exposed position by the forward movement of the sliding member 31 can be maintained at the exposed position. In order to do so, the engaging member 33 may be formed with a predetermined width on the whole or partial surface of the lower surface of the sliding member 31. In case that the engaging member 33 is formed with the predetermined width on the partial surface of the lower surface, the engaging member 33 starts with a predetermined distance from the grip 31*b* installed on the other end portion of the lower surface of the sliding member 31 and extends as much as a predetermined distance toward the one end portion. For example, the engaging member 33 is starting with a distance of about 1 cm from the other end portion of the lower surface of the sliding member 31 and extends as much as about 2 cm toward the connector 31*a* and can be formed into the connection groove with a sufficient width as large as possible to accommodate the engaging protrusion 41*c*. In this case, if the sun visor 20 is moved from the hidden position to the exposed position, the engaging member 33 formed only in the vicinity of the other end portion is not engaged with the engaging protrusion 41*c*, so that the forward movement of the sliding member 31 is not obstructed. One or more engaging members 33 having a predetermined width may be formed on the lower surface. In this case, the engaging member 33 can be engaged with the engaging protrusion 41*c* in stages when the sliding member 31 moves forwards or backwards, so that the exposed position or the hidden position of the sun visor 20 can be maintained and adjusted in stages.

Further, the engaging member 33 may be formed to be saw-toothed with a predetermined width on the whole or partial surface of the lower surface of the sliding member 31, so that a one-way movement of the sliding member 31 can be intermitted. Therefore, a lower surface of the engaging member 33 may include a number of saw-toothed irregularities having an inclined surface on one side and a substantially vertical surface on the other side. In this case, when the sliding member 31 moves forwards, the one side (inclined surface) of the saw-toothed irregularity slides on the engaging protrusion 41*c* moving forwards but it is not engaged with the engaging protrusion 41*c*, so that the sliding member 31 can move forwards. On the contrary, when the sliding member 31 moves backwards, the other side (substantially vertical surface) of the saw-toothed irregularity is caught by the engaging protrusion 41*c*, so that the backward movement of the sliding member 31 is restricted. With this configuration, it is possible to prevent the sun visor 20 at the exposed position from being arbitrarily moved to other positions regardless of the wearer's intention, thereby making the wearer feel comfortable with the helmet on. Alternatively, the engaging member 33 may be formed on one side surface or a top surface of the sliding member 31 and the engaging protrusion 41*c* may be positioned corresponding thereto to be engaged with the engaging member 33, which may restrict the forward and backward movements of the sliding member 31.

The guide holder 35 is a guiding member installed to an inner top portion of the helmet main body 11 and accommodating the sliding member 31. Further, the guide holder 35 may include a fixing part 35*a* and a button assembly accommodating part 35*b*. Furthermore, the guide holder 35 guides the accommodated sliding member 31 along a movement path so that the accommodated sliding member 31 can be moved as much as predetermined in a preset direction when it moves forwards and backwards.

The fixing part 35*a* is a fixing end portion formed at each end portion of the guide holder 35 so that the guide holder 35 can be screw-coupled with the helmet main body 11. The fixing part 35*a* formed at both end portions are fixed to the helmet main body 11 by screws so that the guide holder 35 can be installed at the inner top portion of the helmet main body 11. Alternatively, the fixing part 35*a* may be provided such that the guide holder 35 is attached to the helmet main body 11 by a typical connecting member such as a bolt or an insertion protrusion instead of the screw, or the guide holder 35 is directly attached to the helmet main body 11 by means of welding or the like. Further, the guide holder 35 may include the button assembly accommodating part 35*b* to be configured such that button assembly accommodating part 35*b* accommodates the button assembly 40 that can be engaged with or released from the sliding member 31. The sliding member 31 is maintained as moved forwards and backwards by being engaged with the button assembly 40 accommodated in the button assembly accommodating part 35*b*.

The button assembly accommodating part 35*b* is a portion protruded from a specified position at the guide holder 35 and is capable of accommodating the button assembly 40 to be described later. The button assembly accommodating part 35*b* may be protruded along an external appearance and shape of the button assembly 40 so that the accommodated button assembly 40 can operate and function as required. In order to do so, the button assembly accommodating part 35*b* may be integrally formed with the guide holder 35. The specified position at the guide holder 35 is a position where a manipulation button is exposed to the outside of the helmet so that the helmet wearer can manipulate the manipulation button 41 of the button assembly 40 to be described later (e.g., pressing the manipulation button) with ease.

As illustrated in FIG. 2 and FIGS. 3A and 3B, the guide holder 35 may further include the returning spring 36 connected with its bottom surface.

The returning spring 36 is an elastic spring of which one end is connected with a rear surface of the sliding member 31, and the other end is connected with the bottom surface of the guide holder 35. When the sliding member 31 moves forwards, the other end of the returning spring 36 connected with the guide holder 35 remains as positioned but the one end thereof moves forwards along a moving direction of the sliding member 31, so that the returning spring 36 is lengthened and comes to have elasticity. The elasticity of the returning spring 36 allows the sliding member 31 to automatically return to its original position from the forward position unless any external force is applied or a backward movement is restricted. With this configuration, the helmet wearer can make the sun visor 20 returned rapidly to the hidden position (original position) with a minimum manipulation. However, if the sun visor 20 returns to the hidden position (original position) too fast by the elasticity of the returning spring 36, there may occur a collision between the sun visor 20 and the helmet main body 11. Thus, if the sun visor 20 collides with the helmet main body 11, collision noise delivered to the wearer can be made and a life span of the sun visor 20 made of a relatively fragile material can be shortened.

In order to overcome these problems, the guide holder 35 may further include the damper 37 which is attached to one side of the guide holder 35 so that the damper 37 rotates in gear with the uneven surface portion 32.

The damper 37 is a saw-toothed gearing member attached to one side of the guide holder 35 so as to gear with the uneven surface portion 32 formed at one side surface of the sliding member 31. Since the damper 37 is configured to rotate in gear with the uneven surface portion 32 of the sliding member 31 moving forwards and backwards, when the sliding member 31 moves forwards, the damper 37 rotates in a first direction. On the contrary, when the sliding member 31 moves backwards, the damper 37 rotates in a second direction opposite to the first direction. The damper 37 serves as a resistance to a force applied to the sliding member 31 to move forwards or backwards through the grip 31*b*. That is, even if a strong force (external force moving the sliding member forwards or backwards) is applied through the grip 31*b*, the movement of the sliding member 31 is resisted by the damper 37. Accordingly, it is possible to prevent the sun visor 20 from being suddenly moved to the exposed position or the hidden position by the external force, whereby the wearer can avoid any inconvenience caused by the sudden movement of the sliding member 31 and the sudden opening/closing of the sun visor 20. Further, a collision between the sun visor 20 and the helmet main body 11 can be prevented, and since the sun visor 20 is inserted slowly into the helmet main body 11 at a constant speed, the life span of the sun visor 20 can be lengthened.

Further, even if the damper 37 is configured such that the sliding member 31 automatically returns to the original position from the forward position by the elasticity of the returning spring 36 connected with the bottom surface of the guide holder 35, it can function to protect the sun visor 20. The damper 37 rotates in the first direction or the second direction in gear with the uneven surface portion 32 of the sliding member 31, whereby the elasticity of the returning spring 36 can be attenuated slowly. That is, although the damper 37 rotates in the second direction in gear with the uneven surface portion 32 of the sliding member 31 moving backwards by the elasticity of the returning spring 36, a rotation speed of the damper 37 can not exceed a preset speed due to gearing with the uneven surface portion 32, a resistance or the like. As a result, the damper 37 slowly attenuates the elasticity of the returning spring 36, so that the sliding member 31 slowly moves backwards at a constant speed. Since the sun visor 20 is coupled to the sliding member 31 slowly moving backwards at a constant speed, even if the sun visor 20 moves to the hidden position (original position) by the elasticity, it does not collide with the helmet main body 11.

The damper 37 is a saw-toothed gearing member corresponding to the uneven surface portion 32 formed at the sliding member 31, so that if the uneven surface portion 32 is formed at each side surface of the sliding member 31, the damper 37 may be attached to each side of the guide holder 35 accordingly. Further, the damper 37 may be formed at one or both sides of the guide holder 35 so as to be attached as one body. Alternatively, the damper 37 may be installed at the inner top portion of the helmet main body 11 as a unit independently separated from the guide holder 35 so as to rotate in gear with the uneven surface portion 32 in the first direction or the second direction. Further, as long as the damper 37 can control the speed of the forward and backward movements of the sliding member 31 in gear with the uneven surface portion 32, it may be formed in various shapes other than a saw-tooth shape.

The opening/closing apparatus 30 and the helmet 10 may include the button assembly 40 allowing the sliding member 31 to remain as moved forwards after the forward movement of the sliding member 31 or releasing the forward position of the sliding member 31 to move backwards if necessary.

The button assembly 40 is a engaging member configured to be accommodated in the button assembly accommodating part 35*b* of the guide holder 35. With this configuration, when the button assembly 40 is engaged with the lower surface of the sliding member 31, the position of the sun visor 20 is fixed (i.e., the exposed and hidden positions are fixed), and when the button assembly 40 is released from the lower surface of the sliding member 31, the fixed position of the sun visor 20 can be released (i.e., the sun visor can be moved to be opened or closed).

The button assembly 40 can be engaged with or released from the lower surface of the sliding member 31. In order to do so, the button assembly 40 may include the manipulation button 41 and an elastic member 45.

The manipulation button 41 can be manipulated (e.g., pressed) by the helmet wearer from the top portion of the helmet 10, and is a button member capable of moving the sliding member 31 forwards and backwards. In order to do so, the manipulation button 41 may include a body 41*a*, a cavity 41*b*, the engaging protrusion 41*c* and an elastic protrusion 41*d*.

The body 41*a* is a part of the manipulation button 41 and its upper portion is exposed to the outside of the helmet 10 so that the helmet wearer can press the manipulation button 41 with ease and its lower portion may be inserted and accommodated in the button assembly accommodating unit 35*b*. The body 41*a* can be formed as one body, and its upper surface may be separated as illustrated in FIG. 2. Further, the manipulation button 41 is fitted to the button assembly accommodating part 35*b* so as to be moved vertically, and the body 41*a* may have the cavity 41*b* at a central portion of a main body.

The cavity 41*b* is a hole penetrating the body 41*a* and having an enough width and height for the sliding member 31 to be moved forwards and backwards. The cavity 41*b* may include the engaging protrusion 41*c* protruded upwardly from the bottom surface.

The engaging protrusion 41*c* is a intermitting member engaged with the lower surface of the sliding member 31 moving forwards and backwards through the cavity 41*b*, thereby restricting the forward and backward movements of the sliding member 31. In order to do so, the engaging protrusion 41*c* may include one or more saw-toothed irregularities having an inclined surface on one side and a substantially vertical surface on the other side so as to be engaged with the engaging member 33. In this case, when the sliding member 31 moves forwards, the engaging member 33 is not engaged with the inclined surface on the one side of the engaging protrusion 41*c*, so that the sliding member 31 continues to moves forwards while sliding thereon, thereby rotating forwards. On the contrary, when the sliding member moves backwards, it is caught by the substantially vertical surface on the other side of the engaging protrusion 41*c*, so that the backward movement of the sliding member 31 is restricted. With this configuration, it is possible to prevent the sun visor 20 at the exposed position from being freely moved to other positions regardless of the wearer's intention, thereby making the wearer feel comfortable with the helmet on. Further, by changing a cross section of the engaging protrusion 41*c* or the engaging member 33 engaged therewith, it is possible to prevent the sun visor 20 from being freely open or from being freely moved to the exposed position and the hidden position.

If the engaging member 33 is formed with a predetermined width at a partial portion of the lower surface, it is not engaged with the engaging protrusion 41*c* at the early stage of the forward movement of the sliding member 31. Therefore, the sliding member 31 freely moves forwards and backwards. However, if the sliding member 31 continues to move forwards, the engaging member 33 formed with a preset width at the other end portion is inserted into the cavity 41*b*, whereby the engaging protrusion 41*c* is engaged with the engaging member 33. If one side of the engaging protrusion 41*c* (i.e., one side receiving the clamp inserted forwards in a cross-sectional view) is formed into an inclined surface, the engaging member 33 can continue slidably moving forwards without a big resistance of the engaging protrusion 41*c*. On the contrary, the other side of the engaging protrusion 41*c* is formed into a substantially vertical surface, so that it receives a big resistance when the engaging member 33 moves backwards, whereby the backward movement of the sliding member 31 is restricted. Alternatively, if the one side of the engaging protrusion 41*c* is formed into a substantially vertical surface and the other side is formed into an inclined surface having a lower incline angle than that of the one side, the forward movement of the sliding member 31 may be restricted. Since the engaging member 33 can be provided at the one side surface or the upper surface of the sliding member 31 instead of the lower surface thereof, the engaging protrusion 41*c* engaged with the engaging member 33 can be also protruded from the lateral surface or the upper surface of the cavity 41*b* instead of the bottom surface of the cavity 41*b*.

The engaging protrusion 41*c* can be released from the engaging member 33 when the helmet wearer presses an upper portion of the body 41*a* of the manipulation button 41 exposed at the top portion of the helmet 10. Since the movement of the sliding member 31 is restricted by the engaging member 33 engaged with the engaging protrusion 41*c*, if the manipulation button 41 is pressed and moved downwards, the engaging member 33 is released from the engaging protrusion 41*c* and thus the sliding member 31 is returned to a state possible to move forwards and backwards. That is, if the returning spring 36 is installed between the guide holder 35 and the sliding member 31, the sliding member 31 moves forwards allowing the returning spring 36 to generate an elasticity and automatically moves backwards by the generated elasticity of the returning spring 36. Accordingly, the helmet wearer can move the sun visor 20 from the exposed position to the hidden position by manipulating (e.g., pressing) the manipulation button 41 just one time.

The manipulation of pressing the manipulation button 41 by the helmet wearer from the top portion of the helmet 10 can be made repeatedly by correlation between the elastic protrusion 41*d* and the elastic member 45.

The elastic protrusion 41*d* is protruded downwards from a lower surface of the manipulation button 41 and inserted into the elastic member 45, and the elastic member 45 such as a spring supported by a lower surface of the button assembly accommodating part 35*b*. The manipulation button 41 is configured to go into the helmet 10 along a direction of a pressing force and return back to its original position when the pressing force is removed, so that the helmet wearer can make a manipulation of pressing the manipulation button 41 repeatedly. In order to do so, the manipulation button 41 is supported by the elastic member 45 such as a spring at the lower surface and the elastic protrusion 41*d* is inserted into the elastic member 45 so that the elastic member 45 is not deviated from its own position despite a repetitive use of the manipulation button 41 and functions as required. With this configuration, the button assembly 40 has elasticity, and a manipulation and an automatic cancellation of pressing the manipulation button 40 can be made repeatedly without a malfunction caused by a position deviation of the elastic member 45.

There will be explained an operational state of a helmet 10 in accordance with an embodiment of the present invention in detail with reference to FIGS. 4 and 5.

Figure 4A:
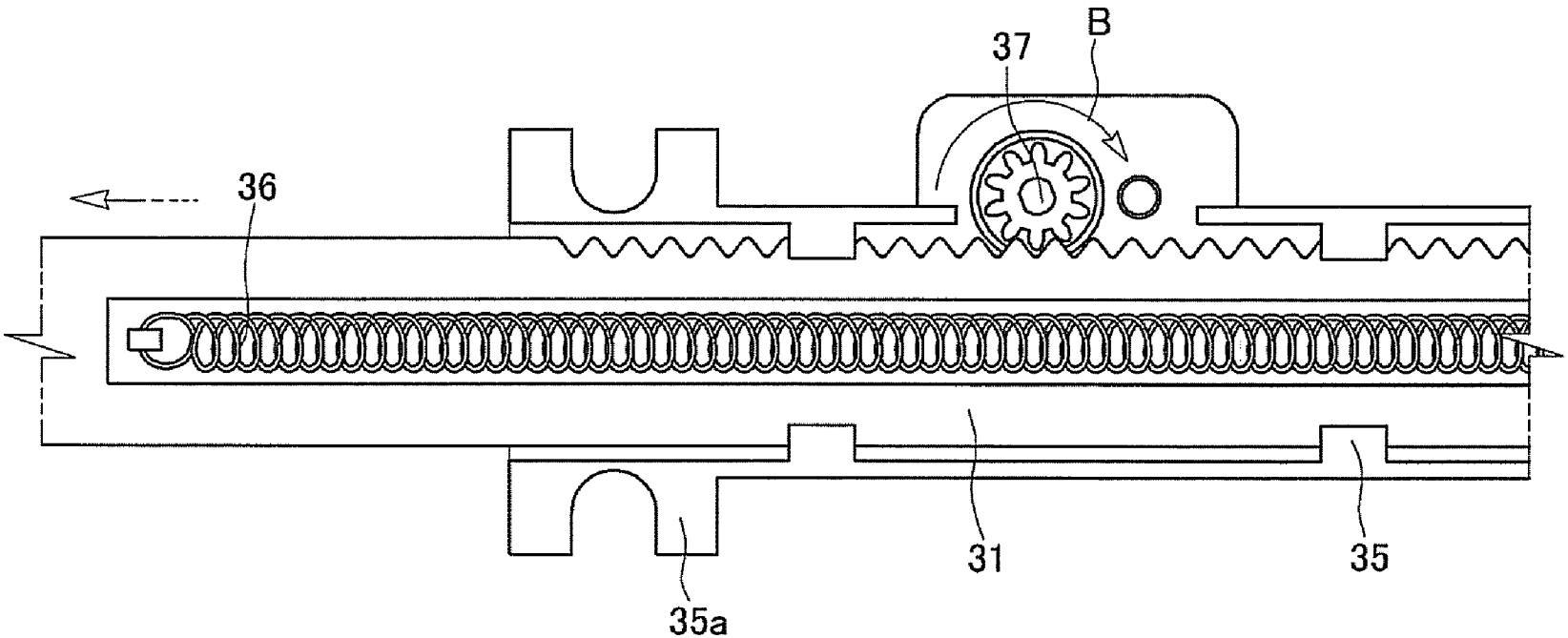
FIGS. 4A and 4B provide views showing that a damper gears into and rotates on an uneven surface portion, and to be specific.
Figure 4B:
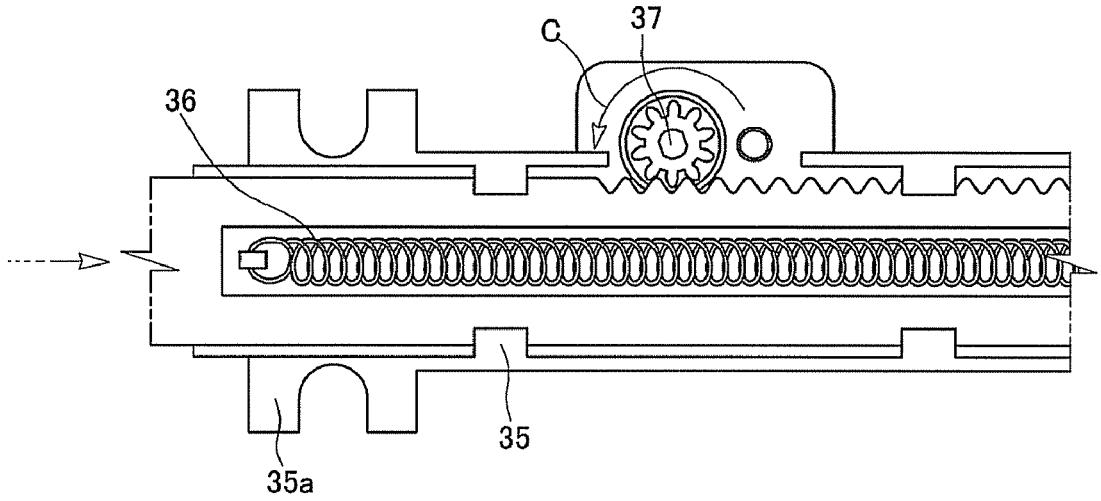

FIGS. 4A and 4B provide a view showing that the damper 37 gears into and rotates on the uneven surface portion 32, and to be specific, FIG. 4A illustrates a case where the sliding member 31 moves forwards, and FIG. 4B illustrates a case where the sliding member 31 moves backwards.

As illustrated in FIGS. 4A and 4B, the opening/closing apparatus 30 and the helmet 10 including the same in the present invention is configured such that the damper 37 gears into the uneven surface portion 32 formed at one side surface of the sliding member 31 moving forwards and backwards at the top portion of the helmet 10.

The helmet wearer can move the sliding member 31 forwards by pulling forwards or pushing forwards the grip 31*b* exposed at the top portion of the helmet 10. The sun visor 20 is coupled to the connector 31*a* of the sliding member 31 and supported by the hinge shafts 13 so as to be opened and closed, so that the sun visor 20 is exposed at the front opening 12 by the forward movement of the sliding member 31. Without the damper 37, a movement speed of the sliding member 31 varies depending on a magnitude of the force applied by the wearer through the grip 31*b* and an opening/closing speed of the sun visor 20 also varies depending on the movement speed. That is, the opening/closing speed of the sun visor 20 exposed at the front opening 12 varies depending on the applied force, which causes inconvenience to the wearer.

Further, if a returning spring 36 is installed between the sliding member 31 and the guide holder 35, the returning spring 36 is lengthened by the forward movement of the sliding member 31 and comes to have elasticity. Without the damper 37, the sun visor 20 is rapidly moved to the hidden position while the sliding member 31 is moving backwards by the elasticity. However, if the sun visor 20 is moved to the hidden position by the wearer's mishandling of the opening/closing apparatus 30, the wearer can not fully respond to a rapid disappearance of the sun visor 20 from the wearer's view and thus the wearer's eyes can be exposed to strong sun light instantaneously. Furthermore, there may occur a problem that the sun visor 20 quickly inserted into the helmet main body 11 collides with the helmet main body 11 due to acceleration.

If the damper 37 is attached to the guide holder 35 and gears into and rotates on the uneven surface portion 32, it is possible for the wearer to appropriately respond to the above-stated problem. When the sliding member 31 moves forwards, the damper gearing into the sliding member 31 rotates in a first direction (in a direction of arrow B of FIG. 4A). The rotation in this manner can decrease the speed of the forward movement of the sliding member 31. Further, the damper 37 rotates in a second direction (in a direction of arrow C of FIG. 4B) opposite to the first direction in gear with the sliding member 31 moving backwards by the returning spring 36, whereby the elasticity of the returning spring 36 is attenuated and a sudden backward movement can be prevented. Therefore, even if the wearer mishandles the opening/closing apparatus 30, the sun visor 20 slowly moving to the hidden position is allowed to take time to move to the exposed position again. Furthermore, since the sun visor 20 is slowly inserted into the helmet main body 11, a collision between the sun visor 20 and the helmet main body 11 can be avoided and thus noise and damage to the sun visor 20 caused by the collision can be prevented.

Figure 5A:
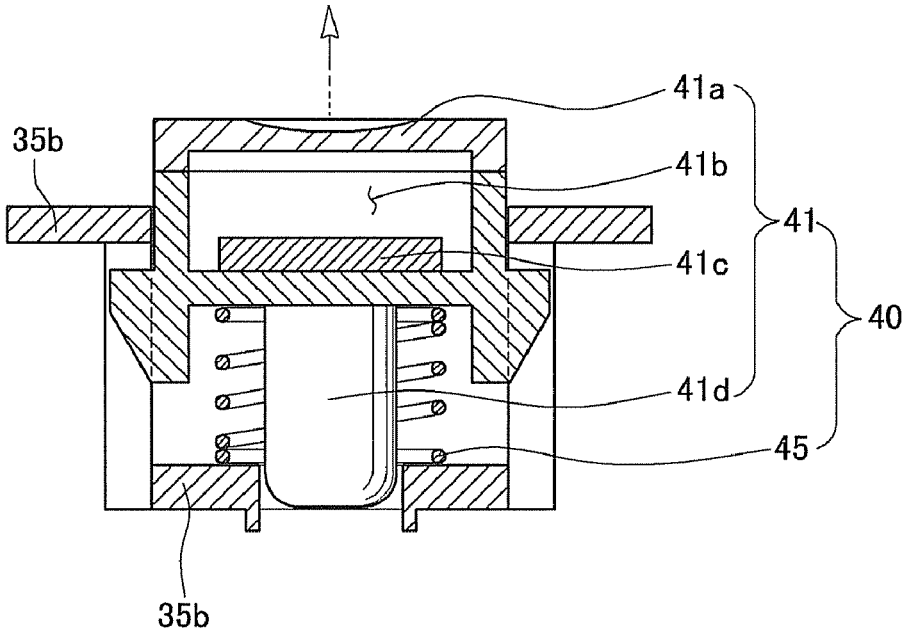
FIGS. 5A and 5B provide longitudinal cross-sectional views showing operations of a button assembly in accordance with an embodiment of the present invention, and to be specific.
Figure 5B:
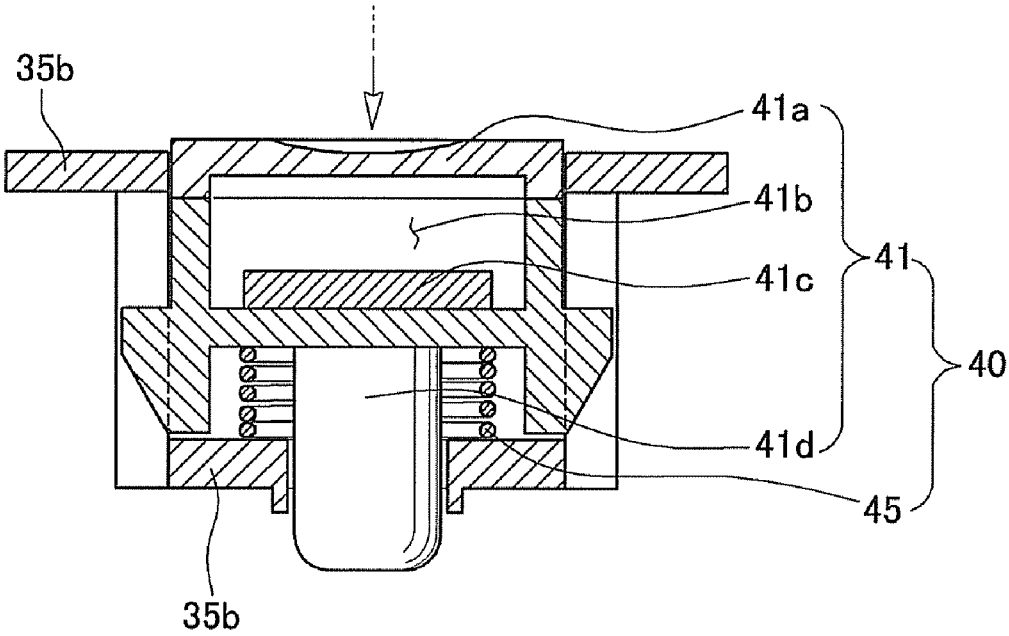

FIGS. 5A and 5B provide longitudinal cross-sectional views showing operations of a button assembly 40 in accordance with an embodiment of the present invention, and to be specific, FIG. 5A illustrates a state before pressing a manipulation button 41 or a returned state after pressing the manipulation button 41 and FIG. 5B illustrates a state right after pressing the manipulation button 41 which moves downwards by force downwardly applied thereto.

There has been explained above a case where the button assembly 40 may be included in the opening/closing apparatus 30 and may include the manipulation button 41 and the elastic member 45. The manipulation button 41 has the cavity 41*b* at its central portion such that the sliding member 31 moves forwards and backwards, and the engaging protrusion 41*c* is protruded upwardly from the lower surface of the cavity 41*b*. Formed on the lower surface of the sliding member 31 are one or more engaging members 33 which can be engaged with the engaging protrusions 41*c*. The engaging protrusions 41*c* are fitly engaged with the engaging members 33, so that they can intermit one-way or two-way movements of the sliding member 31. If the engaging protrusion 41*c* is engaged with the engaging member 33, the forward or backward movement of the sliding member 31 is restricted and thus the sun visor 20 can be maintained as positioned.

The wearer can change the exposed/hidden position of the sun visor 20 just by downwardly pressing an upper surface of the body 41*a* of the manipulation button 41 exposed at the top portion of the helmet 10. If the wearer presses the manipulation button 41 downwardly as illustrated in FIG. 5B, the whole body 41*a* moves downwardly, and the engaging protrusion 41*c* is released from the engaging member 33. In this case, the sliding member 31 can be moved forwards or backwards. Further, the returning spring 36 is provided in an installed state, the backward movement of the sliding member 31 is not any longer restricted by the engaging protrusion 41*c*, so that sliding member 31 can be moved backwards by the returning spring 36. With this configuration, the wearer can move the sun visor 20 to the hidden position just by one-time manipulation action thus to obtain a clear view.

The elastic member 45 may be formed at the lower surface of the body 41*a* and the button assembly accommodating part 35*b* and the elastic protrusion 41*d* may be inserted into the elastic member 45 so that the button assembly 40 can be repeatedly pressed down. With this configuration, if there is no force applied to the upper surface of the manipulation button 41, the body 41*a* is returned to its original position by the elastic member 45 and the engaging protrusion 41*c* returned together to the original position allows the sliding member 31 to be maintained as positioned. Further, with the elastic protrusion 41*d* inserted into the elastic member 45, the elastic member 45 is vertically compressed and repulsed in a repeated manner, so that the button assembly 40 can be used repeatedly without being deviated from its original position.

The above description of the present disclosure is provided for the purpose of illustration, and it would be understood by those skilled in the art that various changes and modifications may be made without changing technical conception and essential features of the present disclosure. Thus, it is clear that the above-described embodiments are illustrative in all aspects and do not limit the present disclosure.

The scope of the present disclosure is defined by the following claims rather than by the detailed description of the embodiment. It shall be understood that all modifications and embodiments conceived from the meaning and scope of the claims and their equivalents are included in the scope of the present disclosure.

The invention claimed is:

1. An opening/closing apparatus capable of manipulating a sun visor, which is opened and closed at a front side of a front opening of a helmet main body, from a top portion of the helmet, the opening/closing apparatus comprising:

a sliding member in which its one end portion is coupled to a central top end portion of a sun visor, and a grip helping the sliding member to move forwards and backwards is formed at another end portion;

a guide holder that is attached to an inner top portion of the helmet main body and guides a forward and a backward movement of the sliding member; and a damper that is a saw-toothed member and is attached to one side of the guide holder, wherein the sliding member includes a returning spring of which one end is connected with a rear surface of the one end portion of the sliding member, and another end is connected with a bottom surface of the guide holder, wherein the returning spring has elasticity when the sliding member moves forwards, and the sliding member is automatically returned to its said original position from a forward position by the elasticity, so that the sun visor automatically moves to a hidden position, wherein a saw-toothed uneven surface portion is formed at one side surface of the sliding member, and wherein when the sliding member is automatically returned to its original position by the elasticity, the damper rotates in gear with the uneven surface portion and attenuates the elasticity so that the sliding member moves backwards slowly and smoothly, thereby preventing the sun visor moving to the hidden position from colliding with the helmet main body.

2. The opening/closing apparatus of claim 1, wherein the sliding member includes:

a connector, at a one end portion, which is coupled to the central top end portion of the sun visor, wherein the connector serves as a connecting groove into which an insertion-type stopper formed at the central top end portion of the sun visor is inserted.

3. The opening/closing apparatus of claim 1, wherein the guide holder includes:

a button assembly accommodating part protruded from a specified position to accommodate a button assembly, wherein the button assembly, while being accommodated in the button assembly accommodating part, is engaged with a lower surface of the sliding member to fix a position of the sun visor and released from the lower surface of the sliding member to cancel the fixed position of the sun visor.

4. The opening/closing apparatus of claim 3, wherein the button assembly includes:

a body constituting a part of the button assembly;

a cavity penetrating the body such that the sliding member is moved forwards and backwards;

a manipulation button that includes an engaging protrusion protruded upwardly from a bottom surface of the cavity and a elastic protrusion protruded downwardly from a lower surface of the body; and an elastic member, to which the elastic protrusion is inserted, configured to elastically support the manipulation button, wherein the engaging protrusion is engaged with an engaging member installed at the lower surface of the sliding member positioned in the cavity by the forward movement of the sliding member, so that the sliding member moved forwards is maintained as moved.

5. A helmet including a sun visor clamped to an inside of a helmet main body through hinge shafts at both sides of the helmet main body, the helmet comprising:

the sun visor detachably clamped to the hinge shafts via through holes formed at both ends to be moved forwards and backwards in front of a front opening; and an opening/closing apparatus including:

a sliding member in which its one end portion is coupled to a central top end portion of the sun visor, a grip helping the sliding member to move forwards and backwards is formed at another end portion, a guide holder that is attached to an inner top portion of the helmet main body and guides a forward and a backward movement of the sliding member, and a damper that is a saw-toothed member and is attached to one side of the guide holder, wherein the sliding member includes a returning spring of which one end is connected with a rear surface of the one end portion of the sliding member, and another end is connected with a bottom surface of the guide holder, wherein the returning spring has elasticity when the sliding member moves forwards, and the sliding member is automatically returned to its said original position from a forward position by the elasticity, so that the sun visor automatically moves to a hidden position, wherein a saw-toothed uneven surface portion is formed at one side surface of the sliding member, and wherein when the sliding member is automatically returned to its original position by the elasticity, the damper rotates in gear with the uneven surface portion and attenuates the elasticity so that the sliding member moves backwards slowly and smoothly, thereby preventing the sun visor moving to the hidden position from colliding with the helmet main body.

6. The helmet of claim 5, wherein the sliding member includes:

a connector, at a one end portion, which is coupled to the central top end portion of the sun visor, wherein the connector serves as a connecting groove into which an insertion-type stopper formed at the central top end portion of the sun visor is inserted.

7. The helmet of claim 5, wherein the guide holder includes:

a button assembly accommodating part protruded from a specified position to accommodate a button assembly, wherein the button assembly, while being accommodated in the button assembly accommodating part, is engaged with a lower surface of the sliding member to fix a position of the sun visor and released from the lower surface of the sliding member to cancel the fixed position of the sun visor.

8. The helmet of claim 7, wherein the button assembly includes:

a body constituting a part of the button assembly;

a cavity penetrating the body such that the sliding member is moved forwards and backwards;

a manipulation button that includes an engaging protrusion protruded upwardly from a bottom surface of the cavity and a elastic protrusion protruded downwardly from a lower surface of the body; and an elastic member, to which the elastic protrusion is inserted, configured to elastically support the manipulation button, wherein the engaging protrusion is engaged with an engaging member installed at the lower surface of the sliding member positioned in the cavity by the forward movement of the sliding member, so that the sliding member moved forwards is maintained as moved.

* * * * *

UNITED STATES PATENT AND TRADEMARK OFFICE

CERTIFICATE OF CORRECTION

PATENT NO. : 8,341,771 B2
APPLICATION NO. : 12/880687
DATED : January 1, 2013
INVENTOR(S) : Chang Seob Lee It is certified that error appears in the above-identified patent and that said Letters Patent is hereby corrected as shown below:

In the specification, column 5 line 62, please add --30-- after the word "apparatus".

In the specification, column 11 line 9, please add --31-- after the word "member".

Signed and Sealed this
Fourteenth Day of May, 2013

Teresa Stanek Rea
*Acting Director of the United States Patent and Trademark Office*